US008152649B2

(12) United States Patent
Bittner

(10) Patent No.: US 8,152,649 B2
(45) **Date of Patent: *Apr. 10, 2012**

(54) GOLF PUTTER AND GRID FOR TRAINING A GOLF PUTTING METHOD

(76) Inventor: Norman Douglas Bittner, St. Helena Island, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,722

(22) Filed: Jul. 14, 2011

(65) Prior Publication Data

US 2011/0269561 A1 Nov. 3, 2011

Related U.S. Application Data

(62) Division of application No. 12/268,231, filed on Nov. 10, 2008, now Pat. No. 8,002,643.

(51) Int. Cl.
*A63B 69/36* (2006.01)

(52) U.S. Cl. ..... 473/265; 473/226; 473/237

(58) Field of Classification Search ..... 473/220, 473/223, 225, 226, 231, 237, 238, 257, 261, 473/262, 264, 265, 266, 278
See application file for complete search history.

(56) References Cited

U.S. PATENT DOCUMENTS

| | | | | |
|---|---|---|---|---|
| 2,090,348 | A | 8/1937 | Ferry | |
| 3,687,459 | A | 8/1972 | Swords | |
| 3,945,646 | A | 3/1976 | Hammond | |
| 3,992,013 | A | 11/1976 | Golden | |
| 4,137,566 | A | 1/1979 | Haas et al. | |
| 4,155,555 | A | 5/1979 | Fink | |
| 4,251,077 | A | 2/1981 | Pelz et al. | |
| 4,254,956 | A | 3/1981 | Rusnak | |
| 4,304,406 | A | 12/1981 | Cromarty | |
| 4,341,384 | A | 7/1982 | Thackrey | |
| 4,535,992 | A * | 8/1985 | Slagle | 473/230 |
| 4,615,526 | A | 10/1986 | Yasuda et al. | |
| 4,858,934 | A | 8/1989 | Ladick et al. | |
| 4,958,836 | A | 9/1990 | Onozuka et al. | |
| 4,962,931 | A | 10/1990 | Jazdzyk, Jr. | |
| 4,971,325 | A | 11/1990 | Lipps | |
| 4,979,745 | A | 12/1990 | Kobayashi | |
| 5,020,802 | A | 6/1991 | af Strom | |
| 5,419,562 | A | 5/1995 | Cromarty | |
| 5,435,547 | A | 7/1995 | Lee | |
| 5,501,463 | A | 3/1996 | Gobush et al. | |
| 5,614,823 | A | 3/1997 | Katayama et al. | |
| 5,638,300 | A | 6/1997 | Johnson | |
| 5,685,782 | A | 11/1997 | Lipps et al. | |
| 5,907,819 | A | 5/1999 | Johnson | |
| 6,095,928 | A | 8/2000 | Goszyk | |
| 6,287,215 | B1 | 9/2001 | Fisher | |
| 6,361,449 | B1 | 3/2002 | Holly | |
| 6,375,579 | B1 | 4/2002 | Hart | |
| 6,739,981 | B1 | 5/2004 | Lin | |
| 6,875,120 | B1 * | 4/2005 | Ellis | 473/2 |

(Continued)

*Primary Examiner* — Nini Legesse
(74) *Attorney, Agent, or Firm* — Nixon & Vanderhye P.C.

(57) ABSTRACT

A golf system for training a golf player includes a golf putter designed to train the user in practicing an unconventional motion and a grid for guiding the motion of the golf putter. The golf putter includes a club head and a plurality of marking instruments such as styluses for marking the trajectory of the putter. The grid includes an enclosure, a recording device to record the trajectory of the golf putter, a plurality of guiding rails and an optional leveling device as well as an optional aiming device, thereby allowing the user to analyze his/her putting trajectory.

15 Claims, 6 Drawing Sheets

U.S. PATENT DOCUMENTS

| | | | | |
|---|---|---|---|---|
| 6,913,544 | B2 | 7/2005 | Tiffin | |
| 7,232,375 | B1 | 6/2007 | Robert et al. | |
| 8,002,643 | B2 * | 8/2011 | Bittner | 473/265 |
| 2001/0005695 | A1 | 6/2001 | Lee et al. | |
| 2002/0077189 | A1 | 6/2002 | Tuer et al. | |
| 2005/0197198 | A1 | 9/2005 | Otten et al. | |
| 2006/0029916 | A1 | 2/2006 | Boscha | |
| 2007/0249428 | A1 | 10/2007 | Pendleton et al. | |

* cited by examiner

GOLF PUTTER AND GRID FOR TRAINING A GOLF PUTTING METHOD

CROSS-REFERENCES TO RELATED APPLICATIONS

This application is a divisional of U.S. patent application Ser. No. 12/268,231, filed Nov. 10, 2008, now U.S. Pat. No. 8,002,643, the entire contents of which is hereby incorporated by reference in this application.

BACKGROUND OF THE INVENTION (1) Field of the Invention

The present invention relates to golf equipment and, more specifically, to golf training equipment.

(2) Description of Related Art Including Information Disclosed Under 37 CFR 1.97 and 37 CFR 1.98.

The traditional "pendulum swing" of a putter, used by most modern golfers, has too many random variables such as the height of the swing, distance of the backswing, speed of the club head on return to the ball for the strike, direction of the aim of club head direction, and rotation of the club head for the mind and muscles to be adequately trained for a consistently successful putt. The traditional pendulum swing is confronted with infinite variables for every putting event and is not recordable and correctable with a device of sufficient capacity that enables making corrections in the putting event. The "pendulum swing" faces its own unique direction, undulation and speed requirements with little opportunity for correction.

Various prior arts disclose a method and apparatus for training a golfer in practicing traditional "pendulum swing" of a putter as described below.

U.S. Published Patent Application No. 2006/0029916 A1 (Boscha) discloses a golf putter for training a golf player, wherein the golf putter has a handle, a head, and sensing unit for sensing parameters. U.S. Published Patent Application No. 2007/0249428 A1 (Pendleton et al.) discloses a putting training device comprising a surface over which a golfer executes a putting stroke, an electric field generator, an electric field detector, a plurality of electrodes responsive to the electric field generator each for producing an electric field and wherein as the golfer executes the putting stroke one or more of the electric fields is perturbed, and wherein the electric field detector detects the perturbed electric field to determine parameters related to putter head movement. U.S. Pat. No. 6,375,579 B1 (Hart) discloses a dynamic laser based golf swing analysis system having single and multiple laser sources which broadcast a monochromatic laser light projected through a cylindrical lens system to generate a series of light planes in space.

In contrast to the "pendulum swing," a "piston motion" reduces the number of variables effecting putting to a more manageable replication, making it possible to "burn" into one's muscle memory a consistent pattern and result. There are new visual, postural and muscle memory events in the "piston motion" technique that are in conflict with traditional approaches to putting—for instance, the stroke contacts the ball at the end of a motion that is as nearly perfectly straight in 3 dimensions as possible. There is no rotation of the club head. There is little or no elevation of the club head off the putting surface that is sufficient for clearance from the ground to generate a smooth path.

BRIEF SUMMARY OF THE INVENTION

The purpose of the present invention is to provide a golf system for training a golf player to practice a non-traditional stroke which is similar to the motion of a piston.

It is an object of the present invention to provide a golf putter comprising a club head which is specially designed to facilitate a piston-like motion and a plurality of marking instruments for marking and recording the trajectory and thus guiding the correct execution for the desired motion for correct direction and distance.

It is another object of the present invention to provide a "grid" for guiding the motion of the golf putter. The "grid" comprises an enclosure, a recording device to record the trajectory of the golf putter, a plurality of guiding rails and an optional leveling device as well as an optional aiming device in the form of a moveable protractor-like instrument.

It is still another object of the present invention to provide a ruler and/or permanent and/or removable gradient color guide to determine the distance by which the putter has to be drawn back as a function of distance between a golf ball and cup.

It is still another object of the present invention to provide a direction guide to record the path of the golf ball after it is stroked. After the ball is hit, the golfer can look at his tracking device and see why his putt was perfect or imperfect.

BRIEF DESCRIPTION OF THE DRAWINGS

The present invention can be more easily understood and the advantages and uses thereof more readily apparent when the following detailed description of the present invention is read in conjunction with the figures, wherein.

In accordance to common practice, the various described features are not drawn to scale (unless denoted otherwise), but are drawn to emphasize specific features relevant to the invention. Like reference characters denote like elements throughout the figures and text.

DETAILED DESCRIPTION OF THE INVENTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

(1) The Design of the Golf Putter

Figure 1:
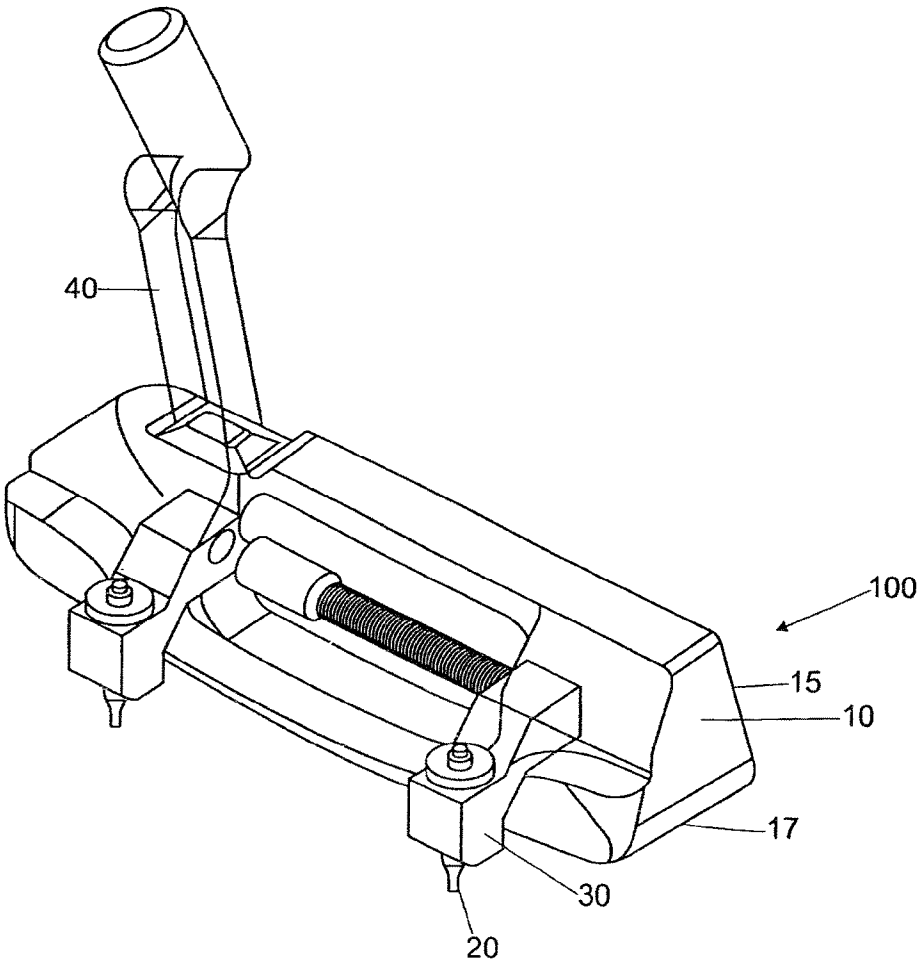
FIG. 1 depicts a golf putter with plurality of marking instruments.

FIG. 1 illustrates a golf putter 100 designed for training a golf player in practicing an unconventional style of stroke similar to the motion of a piston. The putter 100 has a club head 10 to be fixed to a shaft. The club head 10 has a housing 30 which contains marking instruments 20 for marking the trajectory of the swing of the putter 100. Various types of housing can be used such as a housing having a restraining arm connected with a spring which allows for easy attachment and detachment of the marking instruments 20. Several other means can also be used for holding the marking instruments 20 without altering the scope of the invention.

The marking instruments 20 can be styluses, sensors, or implements capable of making delible and indelible marks on the surface below the putter 100. The trajectory of the putter 100 is sketched by the marking instruments 20 on a recording device and the recorded trajectory can be used by the golfer to analyze his or her strokes and practice the piston-like motion.

Figure 2B:
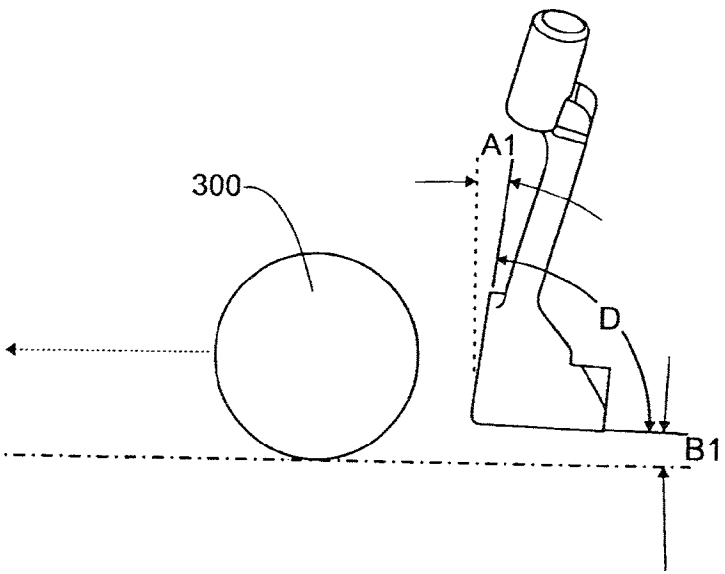
FIGS. 2*a* and 2*b* depict orientation of the club head of the putter before and after hitting a golf ball.
Figure 2A:
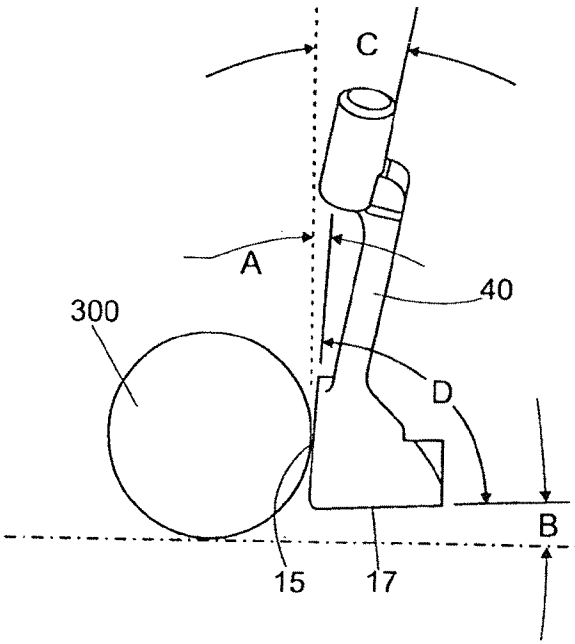

FIG. 2*a* illustrates face angle A (the angle between the face 15 of the club head 10 and the vertical axis), shoe angle B (the angle between the shoe 17 of the club head 10 and the horizontal axis) and hosel angle C (the angle between the hosel 40 of the club head 10 and the vertical axis). These angles have been modified so as to facilitate the piston-like motion of the putter 100.

When the putter 100 is in contact with a golf ball 300, face angle A is (−) 4 degree and the shoe angle B is (−) 2 degree and hosel angle C is (−) 12 degree. The club head 10 is designed such that the face 15 of the club head 10 is at an angle of 84 degrees (D) to the shoe 17 of the club head 10.

After the ball 300 is hit, the face angle A and the shoe angle B change as illustrated in FIG. 2*b*. After contact, the face angle A1 is (−) 8 degrees and the shoe angle B1 is (+) 2 degrees.

(2) The Design of the Grid

Figure 3:
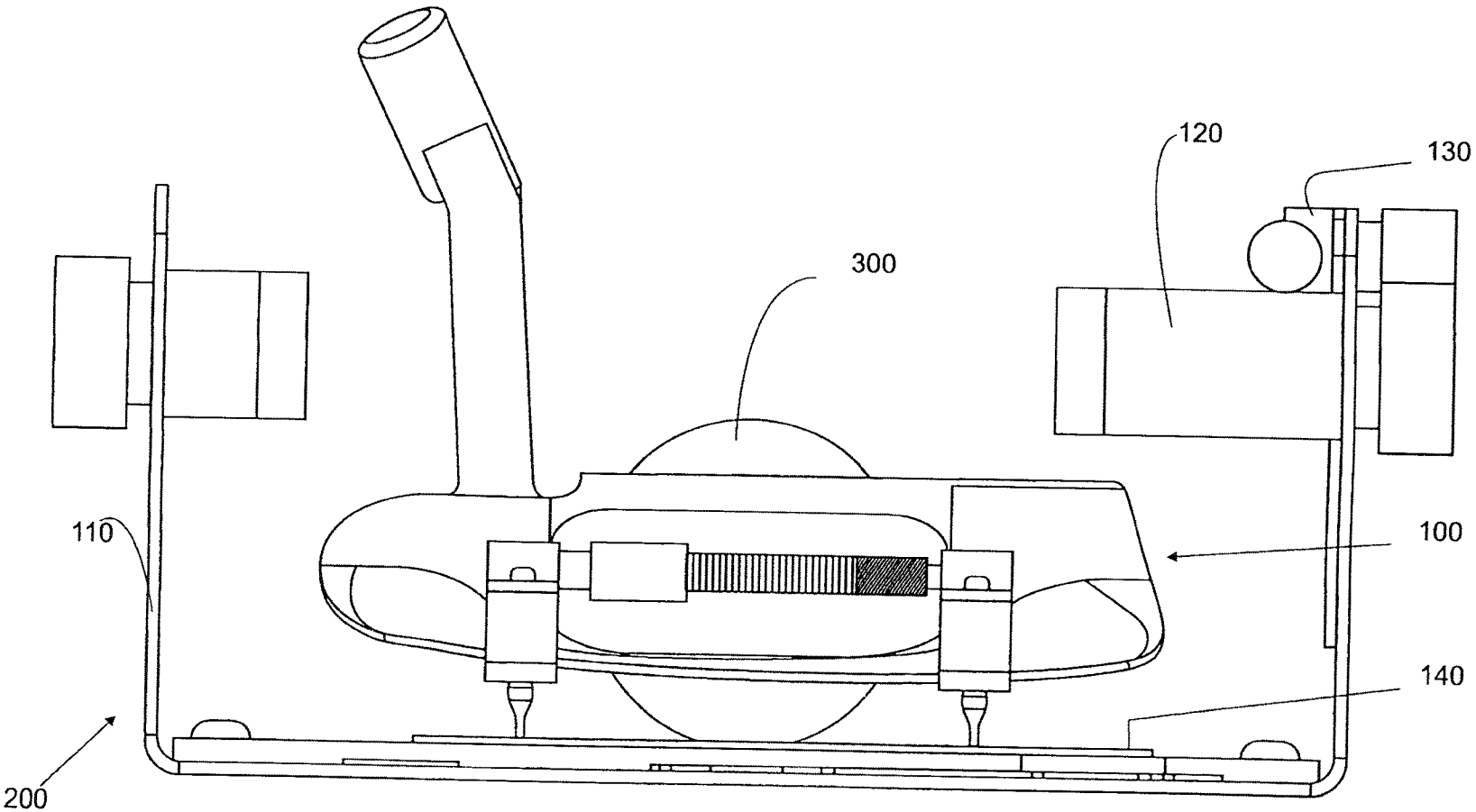
FIG. 3 depicts the golf putter addressing the golf ball in a grid.

FIG. 3 illustrates a grid 200 which is adapted to be used with the putter 100 to train the golf player in practicing and analyzing his or her strokes. The grid 200 guides the movement of the club head 10 of the putter 100 and thus the motion of body of the golfer thereby allowing for replication of the piston-like stroke and development of muscle memory.

Figure 4A:
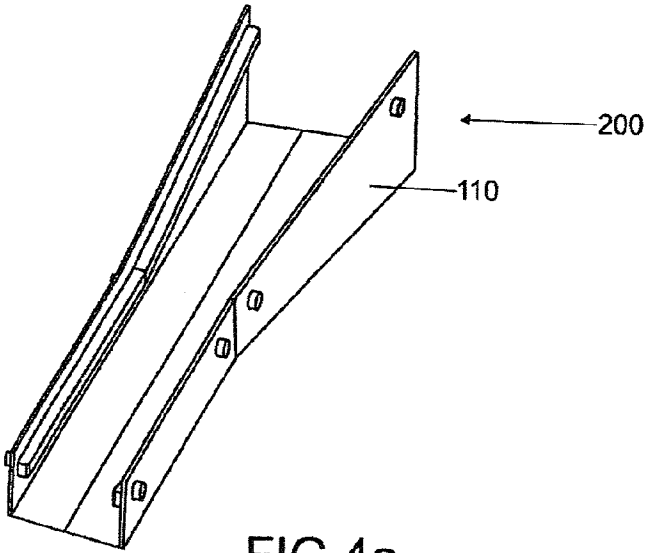
FIGS. 4*a*-4*c* depict the grid for training a golf player.

As illustrated in FIG. 4*a*, the grid 200 comprises an enclosure 110 in which the golf player addresses the golf ball 300. The enclosure 110 has different cross sections at its ends. The end of the enclosure having wider cross section is positioned away from a cup 400.

Figure 4B:
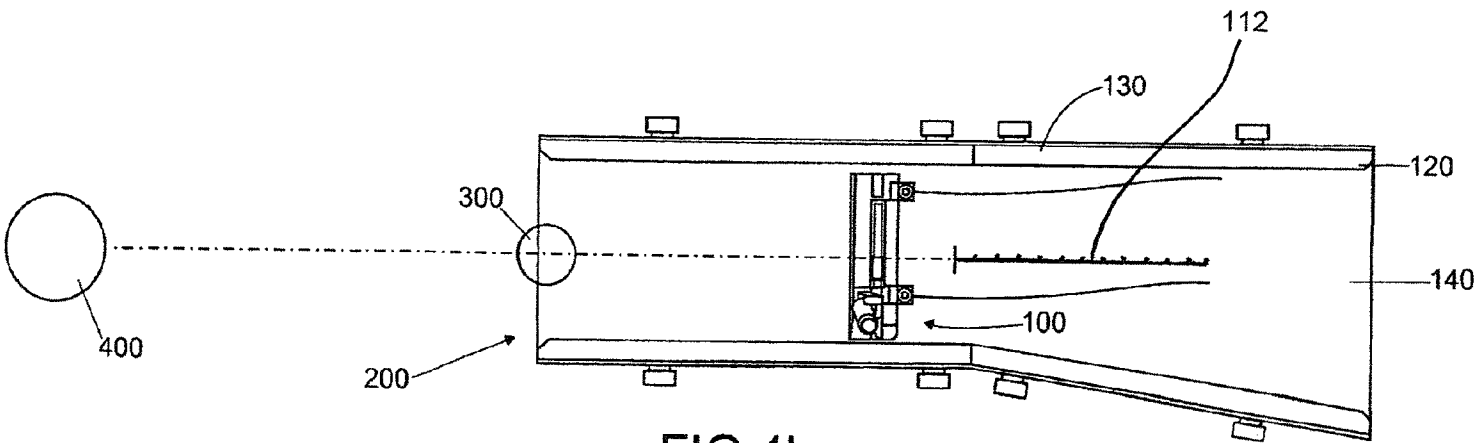

As shown in FIGS. 3, 4*a* and 4*b*, the grid 200 has adjustable guiding rails 120 which are attached to the enclosure 110 for guiding the motion of the club head 10 of the putter 100. The club head motion is replicated into a pattern that can be comfortably memorized by the eye and muscle.

A leveling device 130 is disposed in the grid 200 to compensate for uphill and downhill putts. The gradient of the enclosure 110 can be adjusted with the help of the leveling device 130. Depending on the gradient of the enclosure 110, the golfer can change the velocity with which he or she hits the golf ball 300.

Figure 4C:
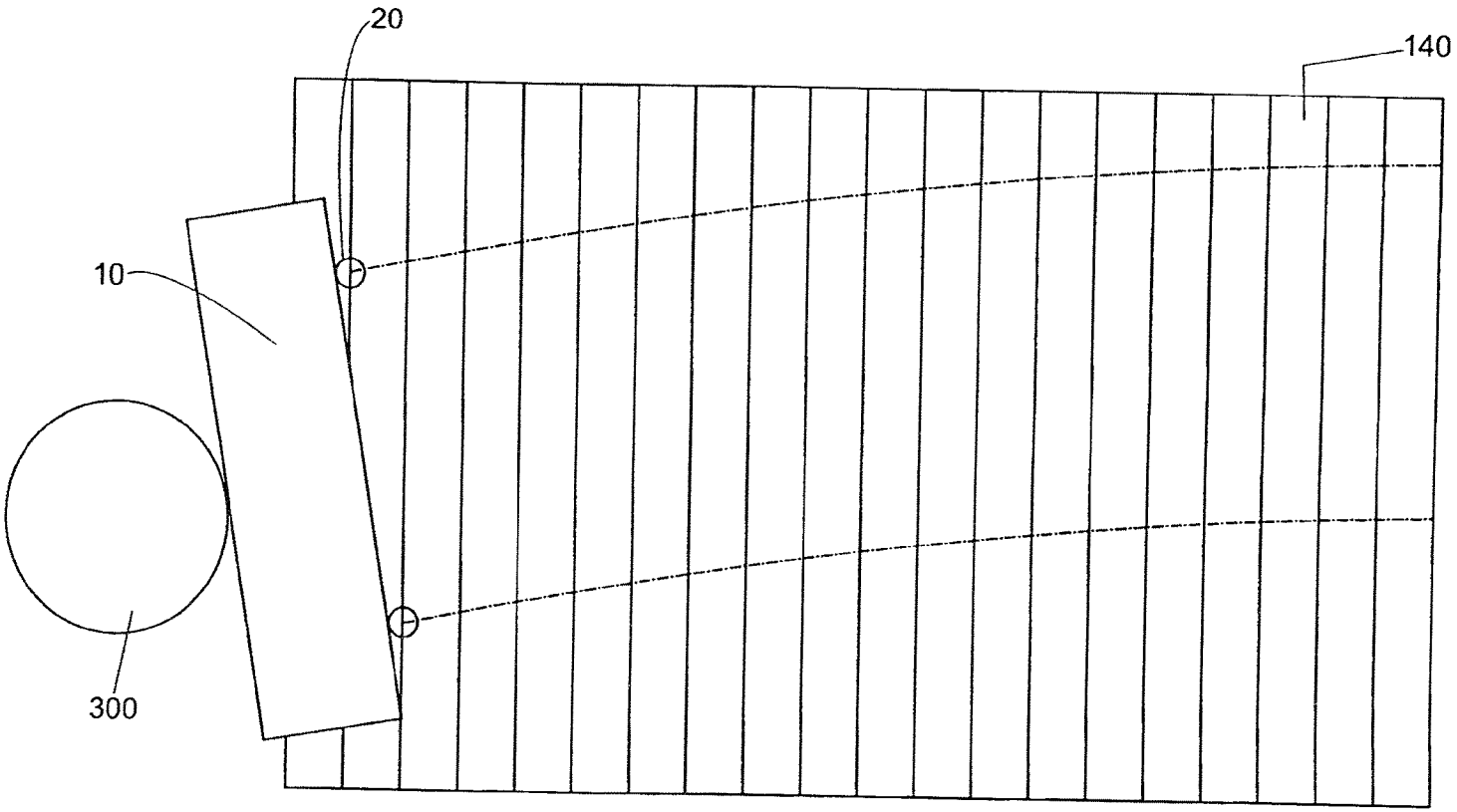

The marking instruments 20 of the putter 100 work in conjunction with a recording device 140 attached to the bottom of the enclosure 110 to record the trajectory of the swing of the putter 100 as illustrated in FIG. 4*c*. The recording device 140 could be a pressure sensitive paper, electronic screen or the like.

In another embodiment of the present invention, the bottom of the enclosure 110 contains a ruler and/or gradient color guide 112 to determine the distance by which the putter 100 has to be drawn back as a function of distance between the ball 300 and the cup 400.

Figure 5A:
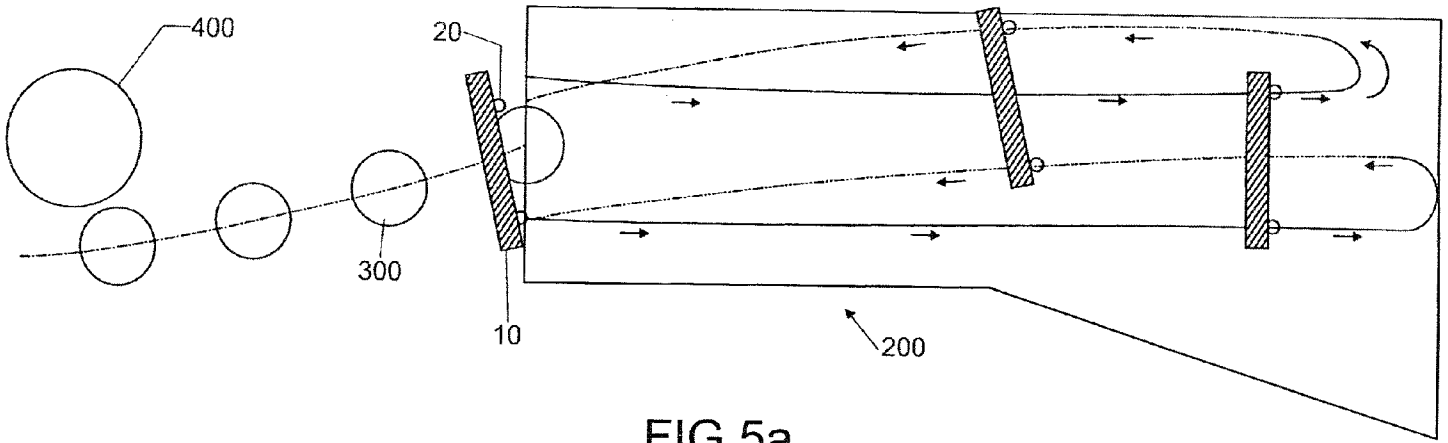
FIGS. 5*a* and 5*b* depict various trajectories of the putter depending on the path and strike of the club head of the putter.
Figure 5B:
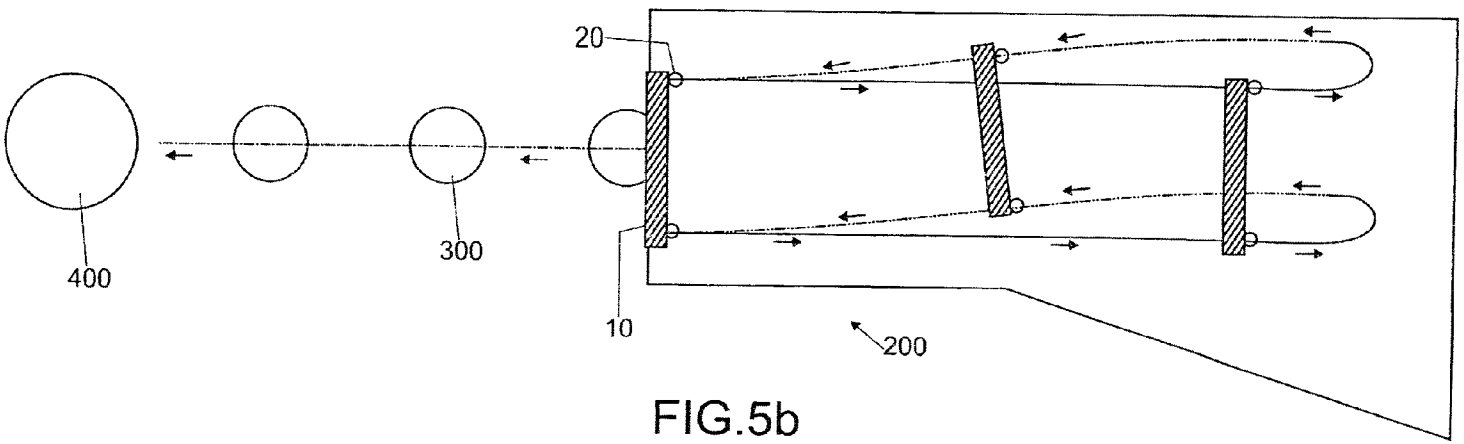

FIG. 5*a* illustrates an imperfect strike and imperfect path of the putter 100 as recorded by the recording device 140. In this case, the face 15 of the putter 100 is not corrected which results in a faulty strike. After correcting the face 15 of the putter 100, a perfect strike is obtained, which is illustrated in FIG. 5*b*. For correcting the path of the putter 100, the golfer has to practice the piston-like motion which teaches the golfer to move the putter 100 in a piston-like action along a straight line.

In another embodiment of the present invention, a direction guide is installed in the grid 200 to record the trajectory of the ball 300 after it is hit. The direction guide helps the golfer in "reading the greens" before and after the putt.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A putter for training a golf player to practice a straight line putting motion, the putter comprising:

a club head including a heel angle between a face of the club head and a shoe of the club head to facilitate said straight line putting motion; and a plurality of detachable marking instruments attached to said club head for marking a trajectory of said putter, a marking end of the marking instruments being positioned entirely behind and below said club head, wherein the detachable marking instruments are positioned on opposite sides of a club head hitting area.

2. The putter according to claim 1, wherein said heel angle is 84 degrees.

3. The putter according to claim 1, wherein each of said marking instruments is disposed in a housing which is attached to said club head.

4. A grid for training a golf player to practice a straight line putting motion, the grid comprising:

an enclosure having different cross-sections at ends thereof;

a plurality of guiding rails attached to said enclosure for guiding motion of a golf club;

means disposed within said enclosure for recording a trajectory of motion of said golf club for assisting said golf player in practicing said straight line putting motion; and a ruler or color gradient disposed in said enclosure to determine the distance by which the putter has to be drawn back as a function of distance between a golf ball and cup, wherein the guiding rails are adjustable, and wherein the guiding rails are spaced from a bottom of the grid by an amount sufficient to a fit a golf club between the guiding rails and the grid bottom.

5. The grid according to claim 4, wherein said recording means is a pressure sensitive paper.

6. The grid according to claim 4, wherein said recording means is an electronic screen.

7. The grid according to claim 4, wherein said golf club is a putter.

8. A grid for training a golf player to practice a straight line putting motion, the grid comprising:

an enclosure having different cross-sections at ends thereof;

a plurality of guiding rails attached to said enclosure for guiding motion of a golf club;

means disposed within said enclosure for recording a trajectory of motion of said golf club for assisting said golf player in practicing said straight line putting motion;

a ruler or color gradient disposed in said enclosure to determine the distance by which the putter has to be drawn back as a function of distance between a golf ball and cup; and a leveling device attached on said enclosure for adjusting a gradient of said enclosure.

9. The grid according to claim 8, further comprising a direction guide attached to said enclosure for recording a trajectory of the golf ball after it is hit.

10. A grid for training a golf player to practice a straight line putting motion, the grid comprising:

an enclosure having different cross-sections at ends thereof;

a plurality of guiding rails attached to said enclosure for guiding motion of a golf club;

means disposed within said enclosure for recording a trajectory of motion of said golf club for assisting said golf player in practicing said straight line putting motion; and a ruler or color gradient disposed in said enclosure to determine the distance by which the putter has to be drawn back as a function of distance between a golf ball and cup, wherein the different cross-sections of the enclosure comprise a first end cross-section and a second end cross-section, and wherein the first end cross section is wider than the second end cross-section.

11. The grid according to claim 10, wherein the enclosure tapers from the first end cross-section toward the second end cross-section.

12. A grid for training a golf player to practice a straight line putting motion, the grid comprising:

an enclosure having a bottom and side walls and including different cross-sections at ends thereof, wherein the different cross-sections of the enclosure comprise a first end cross-section and a second end cross-section, and wherein the first end cross section is wider than the second end cross-section; and a plurality of guiding rails attached to said side walls for guiding motion of a golf club, wherein the enclosure bottom includes a recording surface that records a trajectory of motion of said golf club for assisting said golf player in practicing said straight line putting motion.

13. The grid according to claim 12, wherein said recording surface is a pressure sensitive paper.

14. The grid according to claim 12, wherein said recording surface is an electronic screen.

15. The grid according to claim 12, wherein the enclosure tapers from the first end cross-section toward the second end cross-section.

* * * * *